US010739082B2

(12) United States Patent
Zhang et al.

(10) Patent No.: US 10,739,082 B2
(45) Date of Patent: Aug. 11, 2020

(54) ANTI-PRESSURE STRUCTURE OF HEAT DISSIPATION DEVICE

(71) Applicant: ASIA VITAL COMPONENTS CO., LTD., New Taipei (TW)

(72) Inventors: Jian Zhang, New Taipei (TW); Xiao-Xiang Zhou, New Taipei (TW); Han-Min Liu, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 15/860,664

(22) Filed: Jan. 3, 2018

(65) Prior Publication Data

US 2019/0204018 A1 Jul. 4, 2019

(51) Int. Cl.
*F28D 15/04* (2006.01)

(52) U.S. Cl.
CPC ..... *F28D 15/046* (2013.01)

(58) Field of Classification Search
CPC ..... F28D 15/046; F28D 15/0233
USPC ..... 165/104.26
See application file for complete search history.

(56) References Cited

U.S. PATENT DOCUMENTS 4,461,343 A * 7/1984 Token ..... F28D 15/0233 165/104.26
6,397,935 B1 * 6/2002 Yamamoto ..... F28D 15/0233 165/104.21
6,745,825 B1 * 6/2004 Nakamura ..... F28D 15/0233 165/104.26
6,782,942 B1 * 8/2004 Wang ..... F28D 15/0233 165/104.26
7,275,588 B2 * 10/2007 Hsu ..... F28D 15/0233 165/104.21
7,770,631 B2 * 8/2010 Wang ..... F28D 15/046 165/104.21
8,042,606 B2 * 10/2011 Batty ..... F28D 15/046 165/104.26
9,250,025 B2 * 2/2016 Lee ..... F28D 15/046
9,551,538 B2 * 1/2017 Honmura ..... F28D 15/0233
9,664,458 B2 * 5/2017 Lin ..... F28D 15/046
2002/0020518 A1 * 2/2002 Li ..... F28D 15/0233 165/104.11
2004/0069460 A1 * 4/2004 Sasaki ..... F28D 15/0241 165/104.26
2007/0240860 A1 * 10/2007 Meyer, IV ..... F28D 15/0233 165/104.26
2010/0006268 A1 * 1/2010 Meyer, IV ..... F28D 15/0233 165/104.26

(Continued)

*Primary Examiner* — Devon Russell
(74) *Attorney, Agent, or Firm* — Jackson IPG PLLC; Demian K. Jackson

(57) ABSTRACT

An anti-pressure structure of heat dissipation device includes a main body. The main body has a chamber and a bent section. The chamber has a top side and a bottom side. An anti-pressure member is disposed in the chamber at the bent section. A capillary structure is disposed on the bottom side of the chamber. Two sides of the anti-pressure member respectively abut against the top side of the chamber and a surface of the capillary structure. A working fluid is filled in the chamber. By means of the anti-pressure member, the internal vapor chamber with a bending R angle in the main body is prevented from deformation, contraction or damage due to bending.

9 Claims, 6 Drawing Sheets

(56) References Cited

U.S. PATENT DOCUMENTS

2010/0307722 A1* 12/2010 Ryoson ..... F28D 15/046
165/104.26
2012/0111541 A1* 5/2012 Yan ..... H01L 23/427
165/104.26
2012/0305222 A1* 12/2012 Yang ..... F28D 15/046
165/104.26
2012/0325438 A1* 12/2012 Meyer, IV ..... F28D 15/0241
165/104.26
2013/0037242 A1* 2/2013 Chen ..... F28D 15/0233
165/104.26
2013/0098592 A1* 4/2013 Yang ..... B21D 53/02
165/185
2013/0233518 A1* 9/2013 Liu ..... F28D 15/04
165/104.26
2016/0131440 A1* 5/2016 Lee ..... F28D 15/0233
165/185
2018/0238643 A1* 8/2018 Park ..... F28F 9/26

* cited by examiner

ANTI-PRESSURE STRUCTURE OF HEAT DISSIPATION DEVICE

BACKGROUND OF THE INVENTION

1. Field of the Invention

The present invention relates generally to an anti-pressure structure of heat dissipation device, and more particularly to an anti-pressure structure of a heat dissipation device with a bent section, which can ensure that the vapor chamber at the bent section is bent, while keeping fully free without deformation, contraction or damage due to bending.

2. Description of the Related Art

A conventional vapor chamber and a conventional flat-plate heat pipe are often used in various heat dissipation fields as the heat dissipation components. The major working principle of the vapor chamber and flat-plate heat pipe is that a vacuum and airtight chamber is built in the vapor chamber or the flat-plate heat pipe and a capillary structure is disposed in the chamber. In addition, a working fluid is contained in the chamber. In the vacuum environment, the boiling point of the working fluid is lower than that in a common environment. Therefore, the vapor-liquid circulation of the working fluid can be quickly carried out in the chamber. In this case, the heat can be quickly conducted by a large area or conducted to a remote end.

However, in order to meet the use requirements of various situations, the vapor chamber or the flat-plate heat pipe is no more only in the form of a flat plate. Some manufacturers have shaped the vapor chamber or the flat-plate heat pipe by means of bending, folding or curling in adaptation to the configuration of the application site. When the vapor chamber or the flat-plate heat pipe is shaped, the internal chamber as the vapor passage will be inevitably compressed and deformed. This will affect the vapor-liquid circulation efficiency. Some other manufacturers arrange copper columns in the chamber as support bodies. However, the support bodies in the form of columns cannot be disposed in the position where an R angle or a large-angle curve is formed. As a result, the chamber still may be unsupported and become collapsed or narrowed. Furthermore, the capillary structure at the bent section will be warped or detached due to the bending. All these will greatly deteriorate the heat conduction efficiency of the vapor chamber or the flat-plate heat pipe or even lead to failure of the vapor chamber or the flat-plate heat pipe.

It is therefore tried by the applicant to provide an anti-pressure structure of heat dissipation device to solve the above problems existing in the conventional vapor chamber or flat-plate heat pipe.

SUMMARY OF THE INVENTION

It is therefore a primary object of the present invention to provide an anti-pressure structure of heat dissipation device, which is able to prevent the internal chamber of the vapor chamber or flat-plate heat pipe at the bent section from collapse or contraction so that the vapor-liquid circulation of the working fluid will not be affected.

To achieve the above and other objects, the anti-pressure structure of heat dissipation device of the present invention includes a main body.

The main body has a chamber and a bent section. The chamber has a top side and a bottom side. An anti-pressure member is disposed in the chamber at the bent section. A capillary structure is disposed on the bottom side of the chamber. Two sides of the anti-pressure member respectively abut against the top side of the chamber and a surface of the capillary structure. A working fluid is filled in the chamber.

The anti-pressure member is fully snugly attached to the surface of the chamber and the surface of the capillary structure at the bent section so as to securely support the chamber at the bent section and prevent the capillary structure from being warped. Accordingly, the chamber can keep free without contraction or collapse so that it can be sure that the vapor-liquid circulation of the working fluid in the chamber can stably go on.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
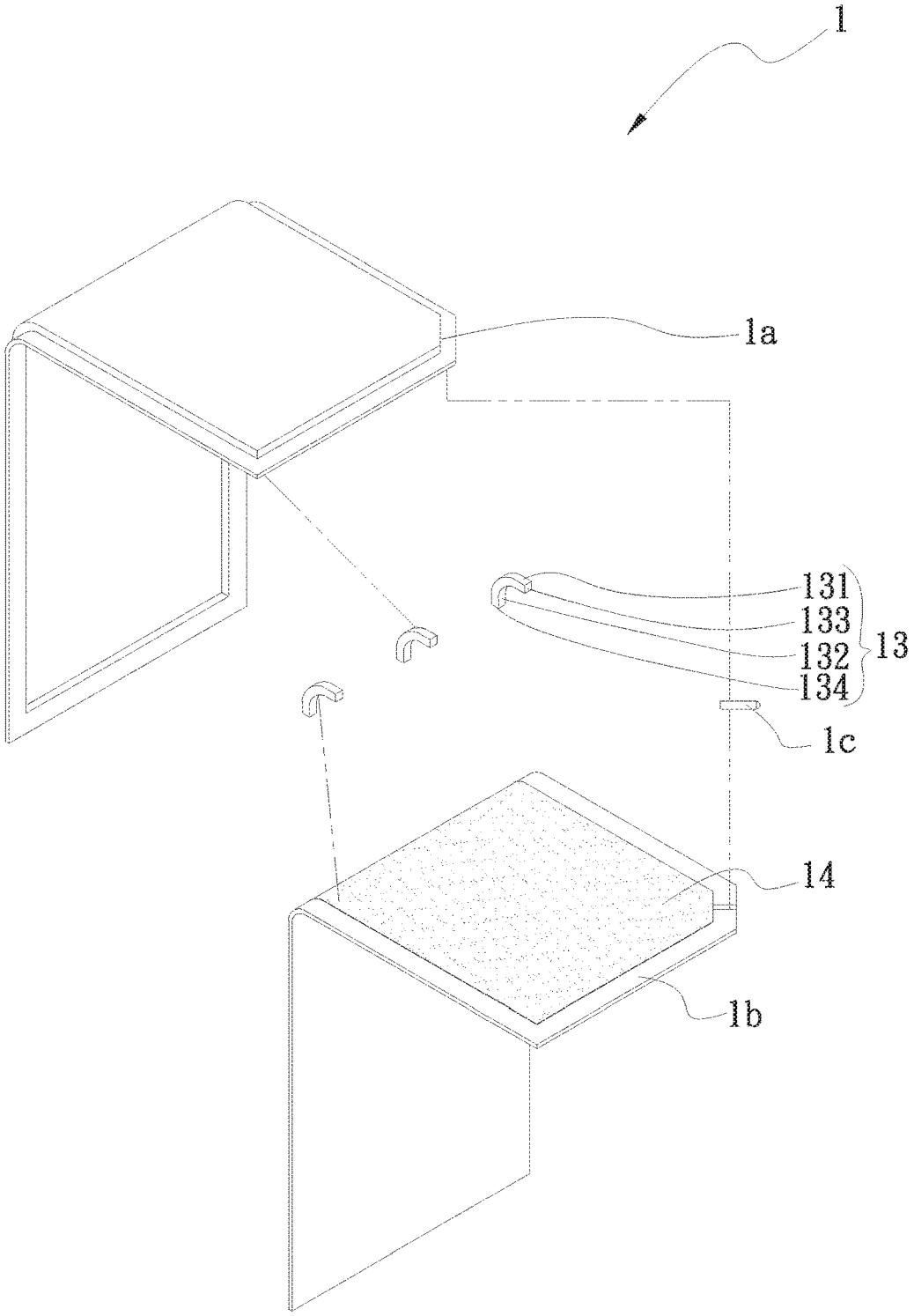
FIG. 1 is a perspective exploded view of a first embodiment of the anti-pressure structure of heat dissipation device of the present invention.
Figure 2:
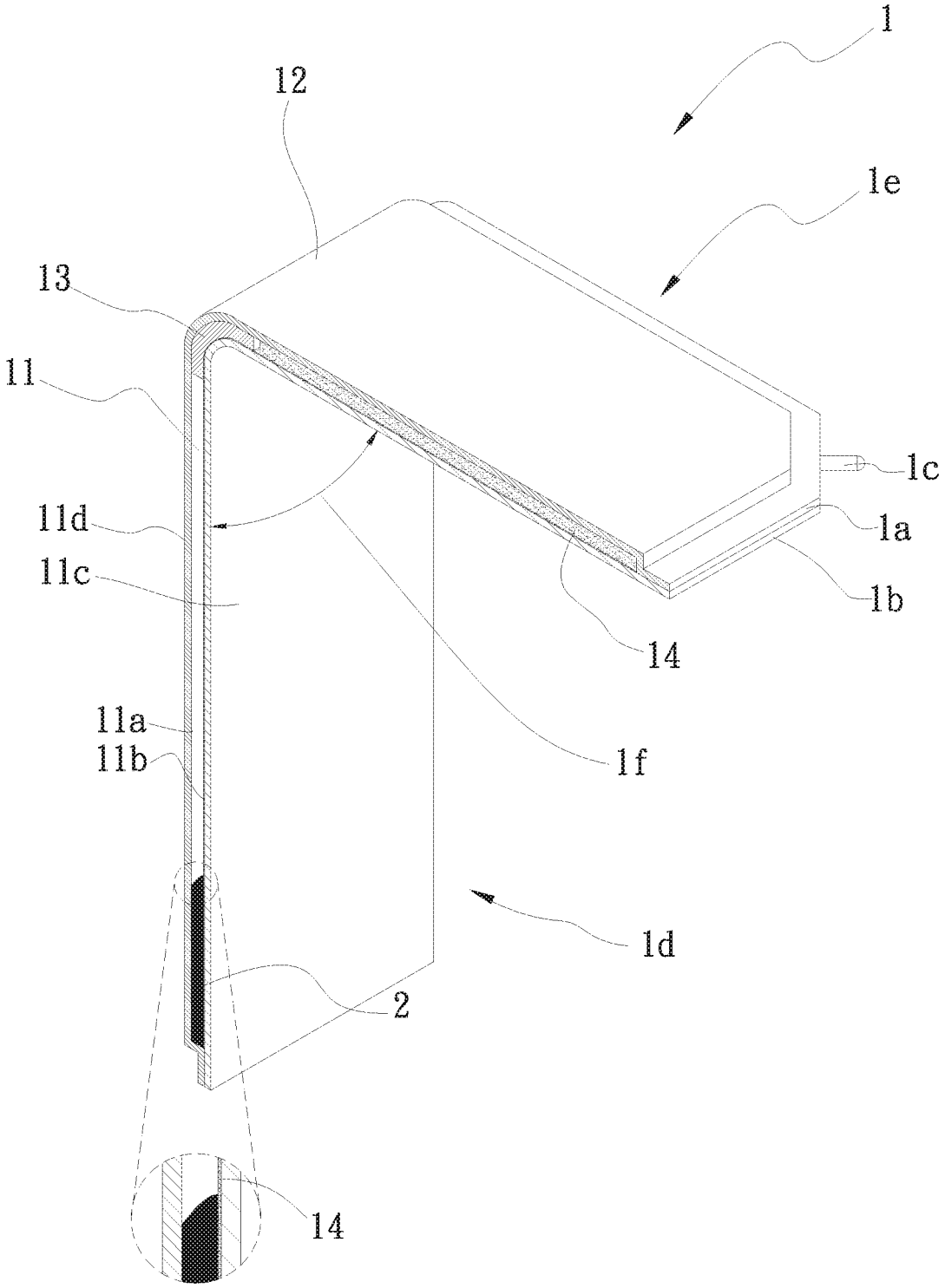
FIG. 2 is a sectional assembled view of the first embodiment of the anti-pressure structure of heat dissipation device of the present invention.

Please refer to FIGS. 1 and 2. FIG. 1 is a perspective exploded view of a first embodiment of the anti-pressure structure of heat dissipation device of the present invention. FIG. 2 is a sectional assembled view of the first embodiment of the anti-pressure structure of heat dissipation device of the present invention. According to the first embodiment, the anti-pressure structure of heat dissipation device of the present invention includes a main body 1.

In this embodiment, the main body 1 is a structural main body 1 of a vapor chamber. The main body 1 has a chamber 11 and a bent section 12. The chamber 11 has a top side 11*a* and a bottom side 11*b*. An anti-pressure member 13 is disposed in the chamber 11 at the bent section 12. A capillary structure 14 is disposed on the bottom side 11*b* of the chamber 11. Two sides of the anti-pressure member 13 respectively abut against the top side 11*a* of the chamber 11 and the surface of the capillary structure 14. A working fluid is filled in the chamber 11.

The outer upper face of the main body 1 is defined as a heat absorption face 11*c*, while the upper lower face of the main body 1 is defined as a condensation face 11*d*. One face of the anti-pressure member 13 is attached to the surface of the top side 11*a* of the chamber 11 at the bent section 12, while the other face of the anti-pressure member 13 is attached to the surface of the capillary structure 14 at the bent section 12. Two ends of the anti-pressure member 13 extend along the surface of the chamber 11 toward two ends of the bent section 12. The anti-pressure member 13 is selected from a group consisting of mesh body, fiber body, sintered powder body and solid rib strip. The anti-pressure member 13 is made of metal material (such as copper, aluminum, stainless steel and titanium) or nonmetal material (such as rubber, plastic and flexible material). The capillary structure 14 is selected from a group consisting of mesh body, sintered powder body, channeled structure and fiber body.

The main body 1 has a first plate body 1*a*, a second plate body 1*b* and a tubular body 1*c*. The first and second plate bodies 1*a*, 1*b* are mated with each other to hold the tubular body 1*c* so as to together define the chamber 11. The tubular body 1*c* communicates with the chamber 11. The first and second plate bodies 1*a*, 1*b* are made of metal material or ceramic material. The metal material is selected from a group consisting of gold, silver, copper, aluminum, stainless steel and titanium.

Two ends of the bent section 12 of the main body 1 have a first extension section 1*d* and a second extension section 1*e*. The two ends of the bent section 12 are respectively connected with the first and second extension sections 1*d*, 1*e*. The first and second extension sections 1*d*, 1*e* contain an angle 1*f*. The bent section 12 has the form of a bent reverse round angle. The anti-pressure member 13 has a first end 133 and a second end 134. The first and second ends 133, 134 extend in the longitudinal direction of the chamber 11 and the capillary structure 14 toward the first and second extension sections 1*d*, 1*e* connected with the bent section 12.

Figure 3:
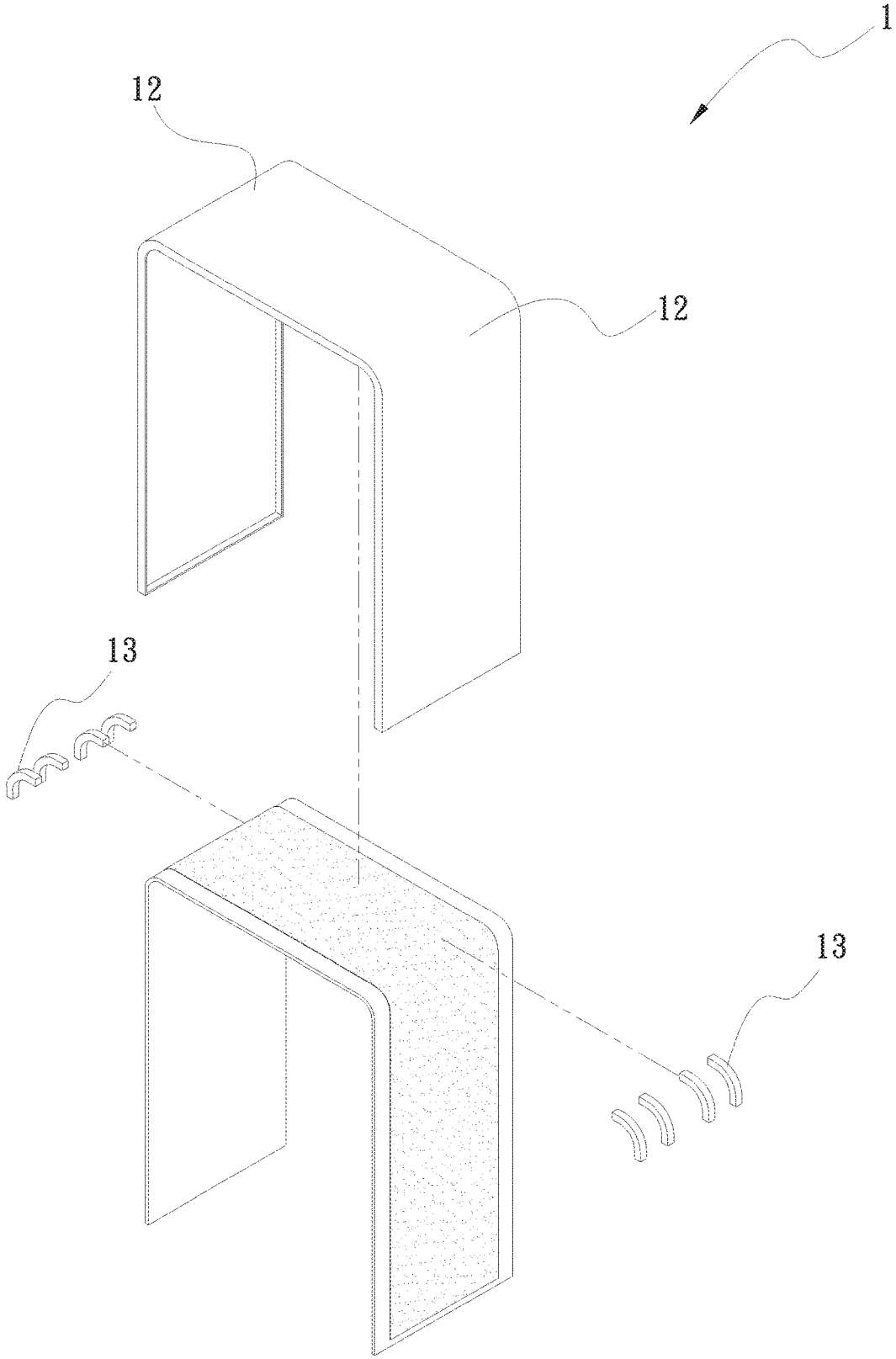
FIG. 3 is a perspective exploded view of a second embodiment of the anti-pressure structure of heat dissipation device of the present invention.
Figure 4:
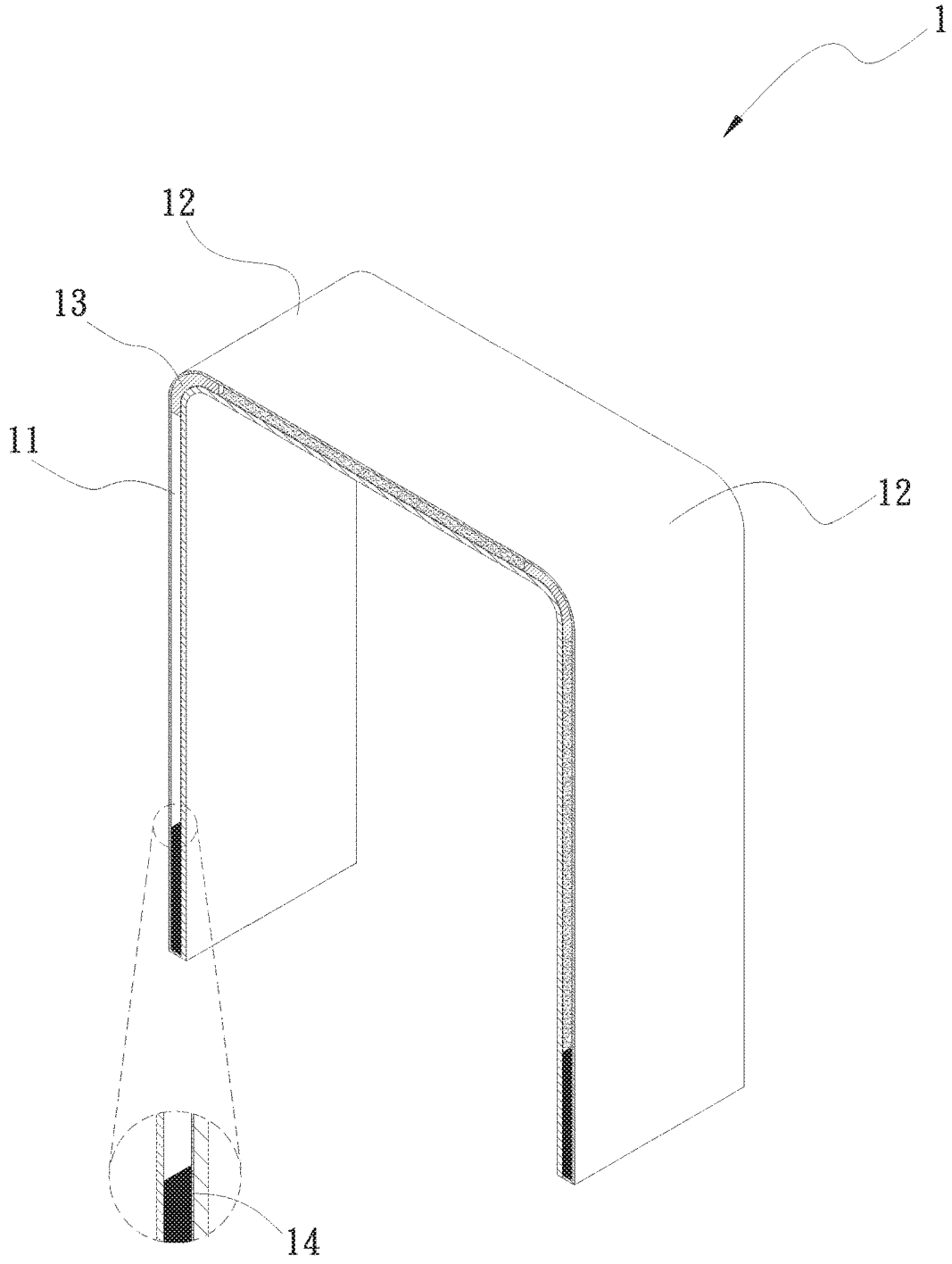
FIG. 4 is a sectional assembled view of the second embodiment of the anti-pressure structure of heat dissipation device of the present invention.

Please now refer to FIGS. 3 and 4. FIG. 3 is a perspective exploded view of a second embodiment of the anti-pressure structure of heat dissipation device of the present invention. FIG. 4 is a sectional assembled view of the second embodiment of the anti-pressure structure of heat dissipation device of the present invention. The second embodiment is partially identical to the first embodiment in structure and thus will not be redundantly described hereinafter. The second embodiment is different from the first embodiment in that the main body 1 is a main body of a flat-plate heat pipe. The anti-pressure member 13 is disposed at the bent section 12, whereby the vapor passage of the chamber 11 at the bent section 12 of the flat-plate heat pipe can keep free without contraction or collapse. In addition, the anti-pressure member 13 serves to enhance the structural strength of the entire heat dissipation device.

Figure 5:
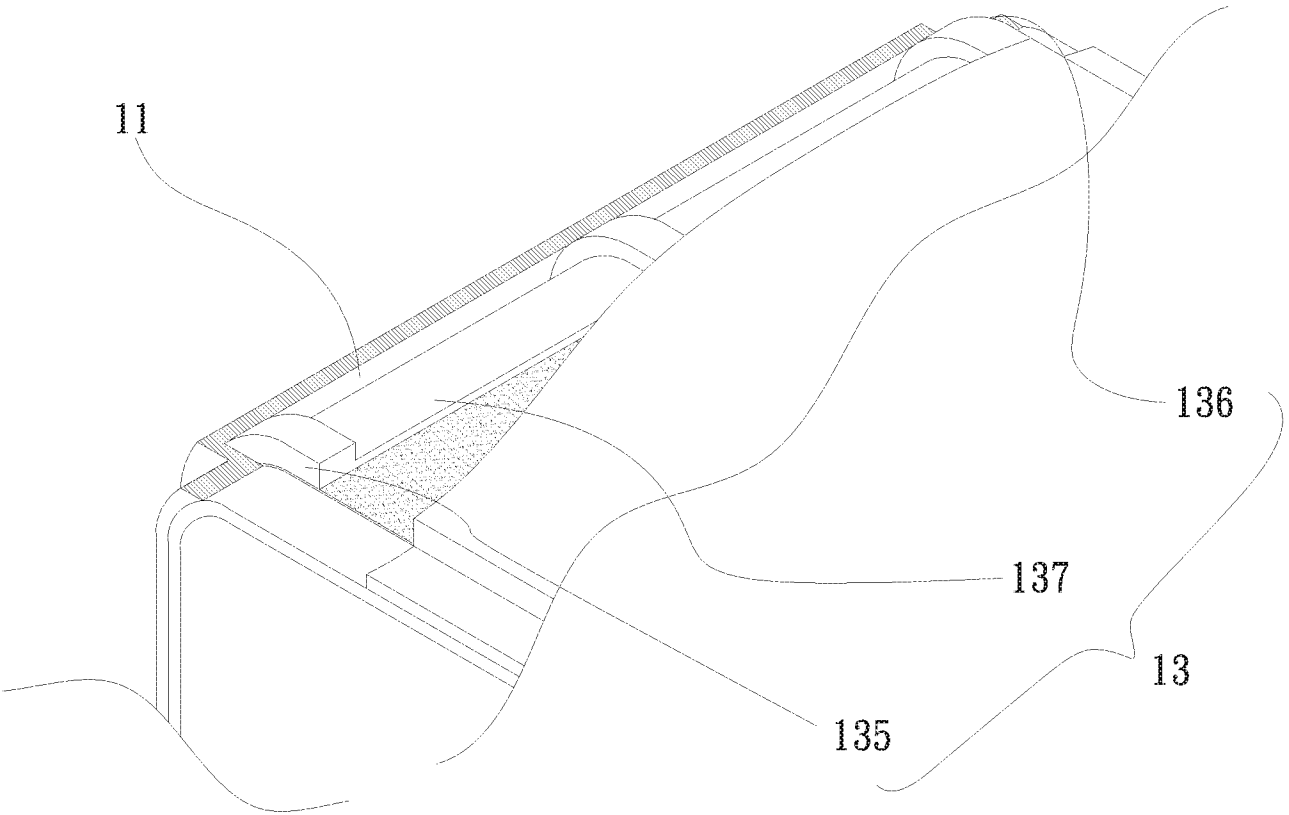
FIG. 5 is a partially sectional assembled view of a third embodiment of the anti-pressure structure of heat dissipation device of the present invention.

Please now refer to FIG. 5, which is a partially sectional assembled view of a third embodiment of the anti-pressure structure of heat dissipation device of the present invention. The third embodiment is partially identical to the first embodiment in structure and thus will not be redundantly described hereinafter. The third embodiment is different from the first embodiment in that the anti-pressure member 13 has a third end 135 and a fourth end 136 disposed at the bent section 12 and extending in the transverse direction of the main body 1. In addition, the anti-pressure member 13 has at least one perforation 137 in communication with the chamber 11.

Figure 6:
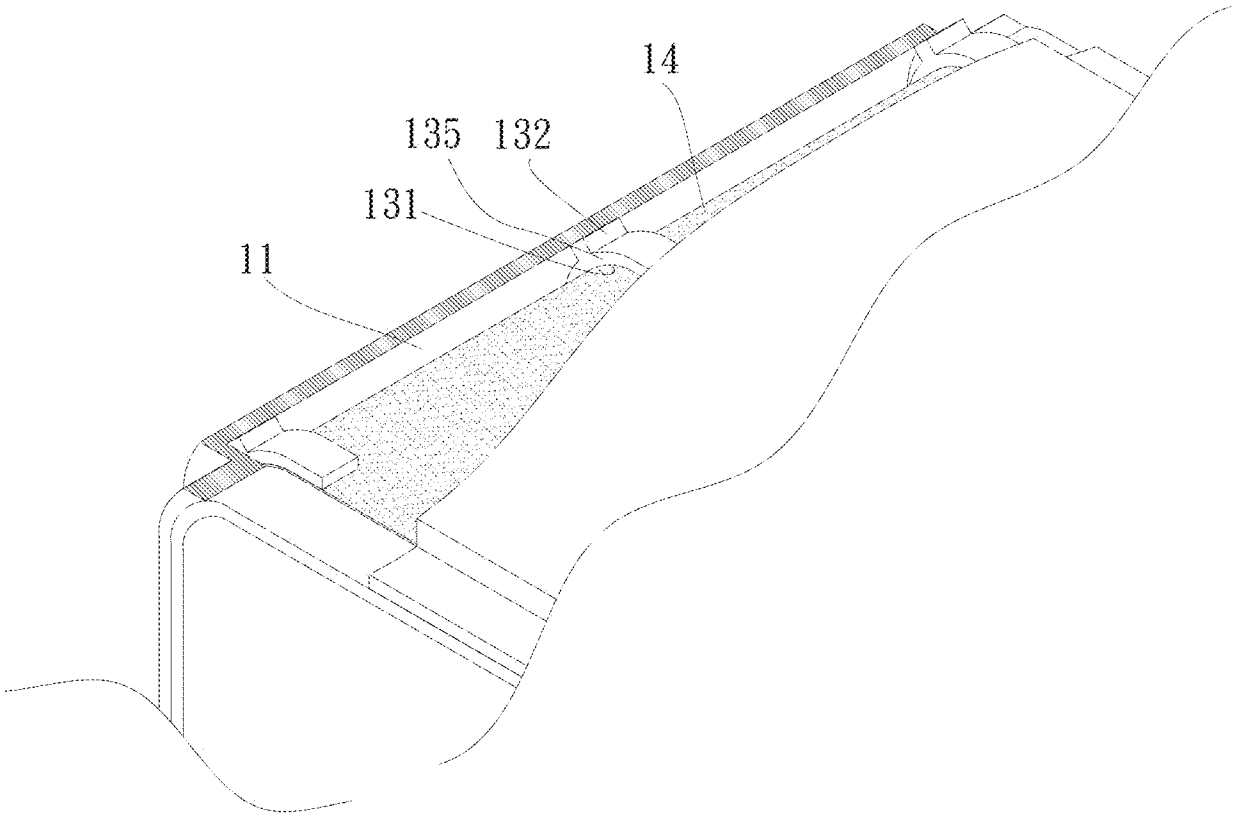
FIG. 6 is a partially sectional assembled view of a fourth embodiment of the anti-pressure structure of heat dissipation device of the present invention.

Please now refer to FIG. 6, which is a partially sectional assembled view of a fourth embodiment of the anti-pressure structure of heat dissipation device of the present invention. The fourth embodiment is partially identical to the first embodiment in structure and thus will not be redundantly described hereinafter. The fourth embodiment is different from the first embodiment in that the anti-pressure member 13 has a first side 131 and a second side 132. The first side 131 has a width larger than a width of the second side 132. The second side 132 correspondingly abuts against the capillary structure 14, while the first side 131 correspondingly abuts against the surface of the chamber 11.

In the present invention, the anti-pressure member 13 is previously fully attached to the upper and lower plate bodies of the vapor chamber or the flat-plate heat pipe at the bent section so as to support the chamber and enhance the structural strength for preventing the chamber from collapse or contraction at the bent section. Accordingly, the chamber as the vapor passage can keep free without losing its effect.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. An anti-pressure structure of a heat dissipation device comprising:

a main body having a chamber with a bent section, the chamber having a top side and a bottom side, an anti-pressure member disposed in the chamber within the bent section and extending continuously transversely between two opposed transverse ends of the bent section, a capillary structure disposed on the bottom side of the chamber, two opposed sides of the anti-pressure member respectively abutting against the top side of the chamber and a surface of the capillary structure, and a working fluid filled in the chamber, wherein two opposite longitudinal ends of the bent section are respectively connected with a first extension section and a second extension section defining an angle therebetween, wherein the anti-pressure member has a first longitudinal end and a second longitudinal end, the first and second longitudinal ends extending along the chamber and the surface of the capillary structure toward the first and second extension sections connected with the bent section, wherein the anti-pressure member has a first side, tabs extending from the first side, and an opposite second side, the tabs each having a first width defined as a curvilinear length of a first path along the first side adjacent the top side of the chamber and a second width defined as a curvilinear length along a second path between the first and second longitudinal ends of the anti-pressure member adjacent the capillary structure, the first width narrower than the second width.

2. The anti-pressure structure of claim 1, wherein the main body has a first plate body, a second plate body and a tubular body, the first and second plate bodies being mated with each other to hold the tubular body so as to together define the chamber, the tubular body communicating with the chamber.

3. The anti-pressure structure of claim 2, wherein the first and second plate bodies are made of metal material or ceramic material, the metal material being selected from a group consisting of gold, silver, copper, aluminum, stainless steel, and titanium.

4. The anti-pressure structure of claim 1, wherein the capillary structure is selected from a group consisting of mesh body, sintered powder body, channeled structure, and fiber body.

5. The anti-pressure structure of claim 1, wherein the anti-pressure member is made of any of copper, aluminum, stainless steel, titanium, rubber, plastic, and flexible material.

6. The anti-pressure structure of claim 1, wherein the main body is a main body of a vapor chamber or a main body of a flat-plate heat pipe.

7. The anti-pressure structure of claim 1, wherein the anti-pressure member has at least one recess in communication with the chamber.

8. The anti-pressure structure of claim 1, wherein an outer upper face of the main body is defined as a heat absorption face, while an upper lower face of the main body is defined as a condensation face, the heat absorption face being opposite to the bottom side of the chamber of the main body, the condensation face being opposite to the top side of the chamber of the main body.

9. The anti-pressure structure of claim 1, wherein the anti-pressure member is interposed between the top side of the chamber and the surface of the capillary structure such that a first side of the anti-pressure member directly abuts the surface of the capillary structure and an opposite second side of the anti-pressure member directly abuts the top side of the chamber such that the capillary structure is interposed between the second side of the anti-pressure member and the bottom side of the chamber.

* * * * *